US008302333B2

(12) United States Patent
Ruvang

(10) Patent No.: US 8,302,333 B2
(45) Date of Patent: Nov. 6, 2012

(54) EXCAVATION TOOTH LIP ADAPTER AND FASTENING SYSTEM THEREFOR

(75) Inventor: John A. Ruvang, Bartonville, TX (US)

(73) Assignee: Black Cat Blades Ltd., Edmonton, Alberta (CA)

( * ) Notice: Subject to any disclaimer, the term of this patent is extended or adjusted under 35 U.S.C. 154(b) by 67 days.

(21) Appl. No.: 12/768,369

(22) Filed: Apr. 27, 2010

(65) Prior Publication Data

US 2011/0258891 A1 Oct. 27, 2011

(51) Int. Cl.
*E02F 9/26* (2006.01)

(52) U.S. Cl. ..... 37/455

(58) Field of Classification Search ..... 37/446, 37/452–460; 172/701.1–701.3; 403/374.3, 403/374.1, 373, 379.4
See application file for complete search history.

(56) References Cited

U.S. PATENT DOCUMENTS

| | | | | |
|---|---|---|---|---|
| 5,088,214 | A | 2/1992 | Jones | |
| 5,311,681 | A | 5/1994 | Ruvang et al. | |
| 5,331,754 | A | 7/1994 | Ruvang | |
| 5,394,629 | A | 3/1995 | Ruvang et al. | |
| D363,074 | S | 10/1995 | Ruvang | |
| D365,109 | S | 12/1995 | Robinson et al. | |
| D365,577 | S | 12/1995 | Ruvang | |
| 5,564,206 | A | 10/1996 | Ruvang | |
| 5,713,145 | A | 2/1998 | Ruvang | |
| 5,718,070 | A | 2/1998 | Ruvang | |
| 5,743,031 | A * | 4/1998 | Launder et al. | 37/455 |
| 5,964,547 | A * | 10/1999 | Brinkley | 403/374.3 |
| 6,041,529 | A | 3/2000 | Ruvang | |
| 6,108,950 | A | 8/2000 | Ruvang et al. | |
| 6,194,080 | B1 | 2/2001 | Stickling | |
| 6,209,238 | B1 | 4/2001 | Ruvang | |
| 6,393,739 | B1 | 5/2002 | Shamblin et al. | |
| 6,439,796 | B1 | 8/2002 | Ruvang et al. | |
| 6,564,482 | B2 | 5/2003 | Ruvang | |
| 6,826,855 | B2 * | 12/2004 | Ruvang | 37/450 |
| 6,976,325 | B2 | 12/2005 | Robinson et al. | |

(Continued)

FOREIGN PATENT DOCUMENTS

WO 9316239 A1 8/1993

OTHER PUBLICATIONS

ESCO Corporation, Whisler Plus™ Adapter System, Mining Regional Training 2006 Presentation, 2006, 27 pages.

(Continued)

*Primary Examiner* — Robert Pezzuto
(74) *Attorney, Agent, or Firm* — Smith IP Services, P.C.

(57) ABSTRACT

A fastening method and adapter configuration for mounting an excavation tooth to an excavation implement lip. A fastening system for the adapter can include a retainer which is receivable in an opening formed through the implement lip. The retainer cannot be removed from the opening while the adapter remains fully engaged with the lip. A method of fastening an adapter to an excavation implement lip can include: installing a retainer in an opening formed through the lip; then engaging the adapter with the retainer and the lip; and then securing the adapter to the lip by biasing the retainer forward. Another fastening system can include a retainer which is receivable in an opening formed through an excavation implement lip, with the retainer including one or more movable teeth and one or more stationary serrations. A wedge biases the retainer forward when the retainer teeth displace relative to the retainer serrations.

29 Claims, 11 Drawing Sheets

U.S. PATENT DOCUMENTS

| | | | |
|---|---|---|---|
| 7,162,818 | B2 | 1/2007 | Ruvang et al. |
| 7,516,564 | B2 | 4/2009 | Ruvang |
| D602,505 | S | 10/2009 | Ruvang |
| 7,681,341 | B2 | 3/2010 | Ruvang |
| 2003/0167663 | A1 | 9/2003 | Champney |
| 2008/0276500 | A1 | 11/2008 | Ruvang |

OTHER PUBLICATIONS

Hensley Adapter Drawings, undated, 4 pages.

International Search Report with Written opinion issued Mar. 23, 2012 for PCT Patent Application No. PCT/US11/049440, 10 pages.

* cited by examiner

EXCAVATION TOOTH LIP ADAPTER AND FASTENING SYSTEM THEREFOR

BACKGROUND

This disclosure relates generally to equipment utilized and operations performed in conjunction with excavation operations and, in an example described below, more particularly provides an excavation tooth lip adapter and fastening system therefor.

Adapters are used for releasably attaching earth-engaging teeth to excavation implements. The teeth are expendable, due to wear and damage resulting from excavation operations, and so the adapters preferably provide for convenient replacement of the teeth.

Unfortunately, the adapters also experience wear and damage and must themselves be replaced from time to time. Thus, there is a continuing need for fastening systems which enable convenient, safe and secure attachment of adapters to excavation implements.

SUMMARY

In the disclosure below, a fastening system is provided which brings improvements to the art of securing adapters to lips of excavation implements. One example is described below in which an adapter is secured to an excavation implement lip by rotating a threaded member to displace a wedge into engagement with the adapter. Another example is described below in which the wedge biases the adapter rearward without the wedge contacting the lip itself.

In one aspect, a fastening system for an excavation tooth lip adapter is provided to the art by the present disclosure. The fastening system can include a retainer which is receivable in an opening formed through a lip of an excavation implement. The retainer cannot be removed from the opening while the adapter remains fully engaged with the lip.

In another aspect, a method of fastening an excavation tooth lip adapter to a lip of an excavation implement is provided. The method can include: installing a retainer in an opening formed through the lip; then engaging the adapter with the retainer and the lip; and then securing the adapter to the lip by biasing the retainer forward relative to the lip.

In yet another aspect, a fastening system for an excavation tooth lip adapter can include a retainer which is receivable in an opening formed through a lip of an excavation implement, with the retainer including one or more movable teeth and one or more stationary serrations. A wedge biases the retainer forward relative to the lip when the retainer teeth displace relative to the retainer serrations.

In a further aspect, an adapter which adapts an excavation tooth to a lip of an excavation implement can include at least one generally longitudinally extending retainer receiving recess formed in a body of the adapter.

In a still further aspect, an adapter which adapts an excavation tooth to a lip of an excavation implement can include an opening formed through a body of the adapter, with the opening including a forward-facing wedge engaging surface.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
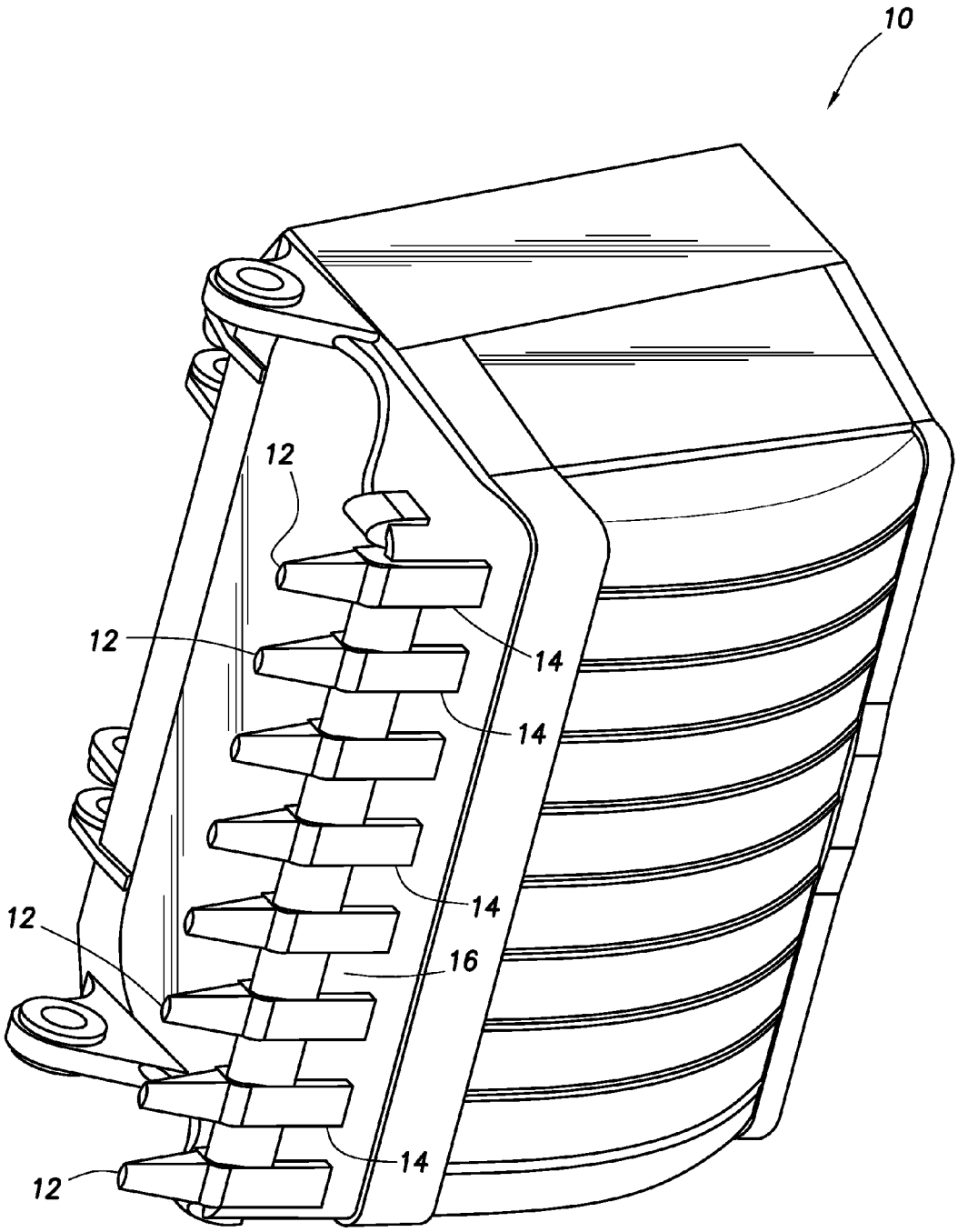
FIG. 1 is a perspective view of an excavation implement which can embody principles of the present disclosure.

Representatively illustrated in FIG. 1 is an excavation implement 10 which can embody principles of this disclosure. In the example of FIG. 1, the implement 10 is of the type known as a "dipper" or "bucket" of a cable shovel, but it should be clearly understood that the principles of this disclosure can be utilized with other types of excavation implements.

In the illustration of FIG. 1, the implement 10 is rotated so that an earth-engaging side of the implement is clearly visible. From this perspective, it may be seen that multiple teeth 12 are mounted on the implement 10 for piercing the earth.

These teeth 12 are typically rapidly worn down or otherwise damaged during use of the implement 10, and so replacement of the teeth should be conveniently, economically, rapidly and safely accomplished. These objectives are obtained, according to the principles of this disclosure, by use of specially configured adapters 14 which releasably secure the teeth 12 to a forward edge of a lip 16 of the implement 10.

Figure 2:
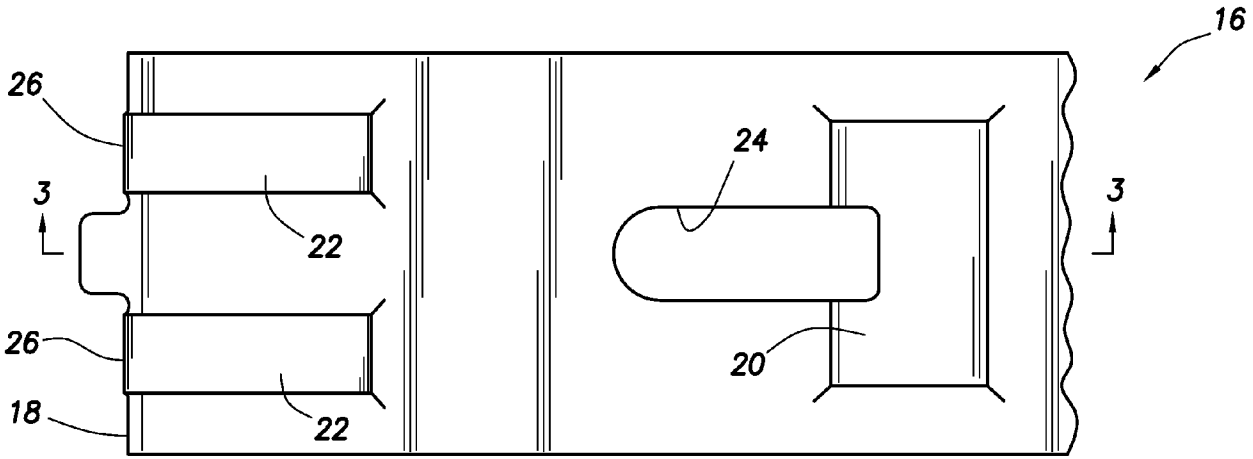
FIG.2 (PRIOR ART)
FIG. 2 is an enlarged scale plan view of a section of a lip which may be part of the implement of FIG. 1.

An enlarged scale plan view of a forward section of the lip 16 is representatively illustrated in FIG. 2. As used herein, the term "forward" is used to indicate a direction toward a front edge 18 of the lip 16, and the term "rearward" is used to indicate a direction away from the front edge of the lip.

The section of the lip 16 depicted in FIG. 2 is used to mount one of the adapters 14 to the lip. One of the lip sections is used to mount each of the adapters 14. Thus, the lip 16 includes a series of laterally spaced apart ones of the section shown in FIG. 2.

Figure 3:
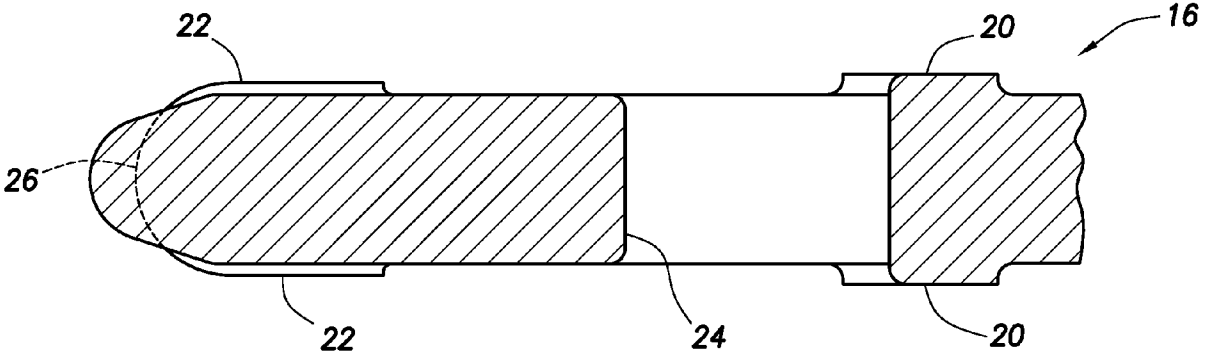
FIG.3 (PRIOR ART)
FIG. 3 is a cross-sectional view of the lip section of FIG. 2, taken along line 3-3.

FIG. 3 illustrates a cross-sectional view of the section of the lip 16, taken along line 3-3 of FIG. 2. In this view, it may be seen that the lip 16 includes pads 20, 22 (known to those skilled in the art as "fit pads"). An opening 24 extends through the lip 16 adjacent the pads 20.

The pads 20 are preferably spaced apart from each other a known distance, and within a known dimensional tolerance. Similarly, the pads 22 are preferably spaced apart from each other a known distance, and within a known dimensional tolerance, but also wrap around the front 18 of the lip 16 to provide a forward surface 26 which engages and pushes the adapter 14 during earth-penetrating movement of the implement 10.

The configuration of the lip 16 section depicted in FIGS. 2 & 3 has been used for over a century, and is known as a Whisler-type of lip configuration. Unfortunately, the pads 20, 22 are subject to wear in use, and so it was common practice in the past to configure adapters so that they clamp down on the pads 20, in order to prevent movement between the adapters and lip 16. However, this clamping arrangement frequently generated excessive bending stresses in the adapters, leading to premature failure of the adapters.

Figure 4:
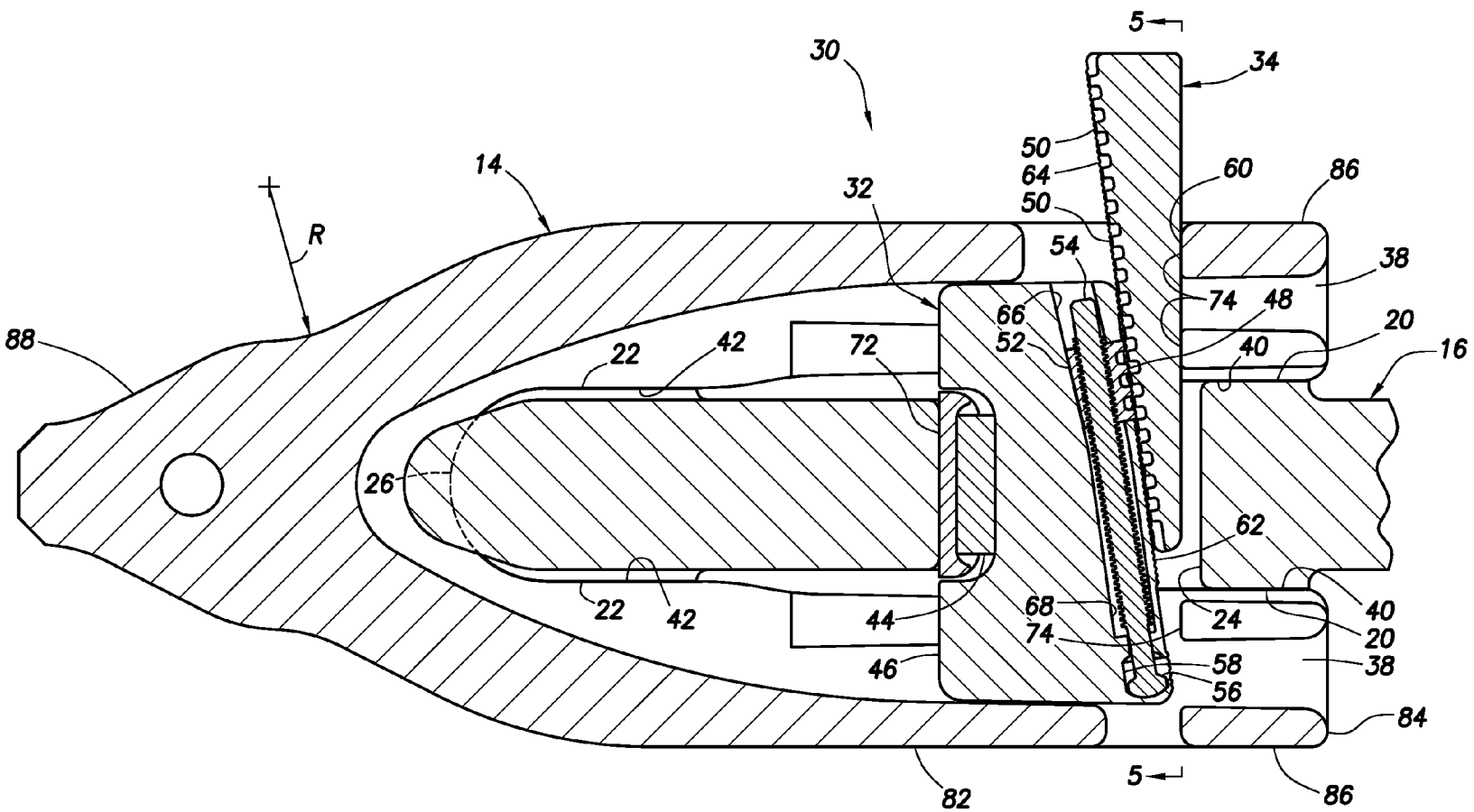
FIG. 4 is a cross-sectional view of a fastening system and associated method which embody principles of the present disclosure, taken along line 4-4 of FIG. 11.

Referring additionally now to FIG. 4, a cross-sectional view of a fastening system 30 and associated method which embody principles of the present disclosure are representatively illustrated. The fastening system 30 may be used in conjunction with the adapter 14 and lip 16 depicted above, or the fastening system may be used with other adapters and/or lips.

The fastening system 30 includes a retainer 32 which is received in the opening 24, and a wedge 34 which biases the retainer forward relative to the lip 16, while biasing the adapter 14 rearward relative to the lip.

In one unique feature of the fastening system 30, the retainer 32 includes projections 36 (not visible in FIG. 4, see FIG. 5) which slidingly engage longitudinally extending slots or recesses 38 formed in the adapter 14. This engagement between the projections 36 and recesses 38 operates to align the retainer 32 vertically (as depicted in FIG. 4) relative to the opening 24, and operates to prevent spreading apart of legs 86 of the adapter 14 in use.

In another unique feature, the retainer 32 does not clamp the adapter 14 onto the pads 20. Instead, the adapter 14 is configured with inner surfaces 40, 42 closely dimensionally matched to the respective pads 20, 22. Thus, bending stresses are not imparted to the adapter 14 by any clamping action.

In yet another unique feature, the retainer 32 includes a biasing device 44 which biases a body 46 of the retainer rearward when the wedge 34 is installed. As depicted in FIG. 4, the biasing device 44 includes a resilient elastomeric material which is compressed when the wedge 34 displaces the retainer 32 forward. However, other types of biasing devices (such as springs, etc.) may be used, if desired.

In a further unique feature, the retainer 32 includes movable teeth 48 which engage teeth 50 formed on the wedge 34. By displacing the teeth 48 upward or downward (as depicted in FIG. 4) relative to the retainer body 46, the wedge 34 can be respectively raised or lowered relative to the adapter 14 and retainer 32.

The teeth 48 are formed on a carrier 52 which is slidably mounted relative to the retainer body 46. The carrier 52 is also threadedly engaged with a threaded member 54 which is rotatably mounted to the retainer body 46. By rotating the threaded member 54 in one direction, the carrier 52 can be displaced upward (to thereby displace the wedge 34 upward), and by rotating the threaded member in an opposite direction, the carrier can be displaced downward (to thereby draw the wedge downward).

Note that an enlarged head 56 of the threaded member 54 is received in a vertically elongated pocket 58 formed in the retainer body 46. In this manner, the threaded member 54 is permitted to reciprocably displace a limited distance relative to the retainer body 46.

Another unique feature of the fastening system 30 is that serrations 62, 64 are formed on mating surfaces of the respective retainer 32 and wedge 34. Engagement between these serrations 62, 64 prevents the wedge 34 from displacing relative to the retainer 32 in operation of the implement 10, and actually increases resistance to such displacement when the adapter 14 is subject to loads tending to pull the adapter off of the lip 16.

As depicted in FIG. 4, the wedge 34 has been installed in an upper opening 60 formed in the adapter 14. The wedge 34 is in contact with a forward-facing surface of the opening 60, and with a rearward-facing side of the retainer 32. The retainer teeth 48 have not yet engaged the wedge teeth 50. The head 56 of the threaded member 54 is at a lower end of the pocket 58 in the retainer body 46. The biasing device 44 has not yet been compressed.

In this configuration, the wedge 34 is being installed in, or is being removed from, the adapter 14. Since the teeth 48, 50 are not engaged with each other, the wedge 34 can be displaced upward or somewhat downward relative to the retainer 32. The resilience of the biasing device 44 allows the serrations 62, 64 to pass over each other.

Note that the carrier 52 is positioned so that it is in contact with an upper inclined surface 66 of the retainer body 46. This surface 66 is inclined upwardly away from the wedge 34, so that the teeth 48 can disengage from the teeth 50.

However, if the threaded member 54 is rotated in an appropriate direction (preferably, in a clockwise, right-hand direction) relative to the retainer body 46, the carrier 52 will displace downward, and will contact another surface 68 which is generally parallel to the wedge 34 surface which engages the retainer 32. Thus, downward displacement of the carrier 52 from its position as depicted in FIG. 4 will cause the carrier to also displace toward the wedge 34, thereby causing the teeth 48 to engage the teeth 50.

Both the carrier 52 and the threaded member 54 pivot clockwise (as viewed in FIG. 4) relative to the retainer body 46 as the carrier displaces downward relative to the surface 66. The limited reciprocal displacement of the head 56 relative to the pocket 58 in the retainer body 46 allows the teeth 48 to align with the teeth 50 as the carrier 52 displaces downward.

Figure 5:
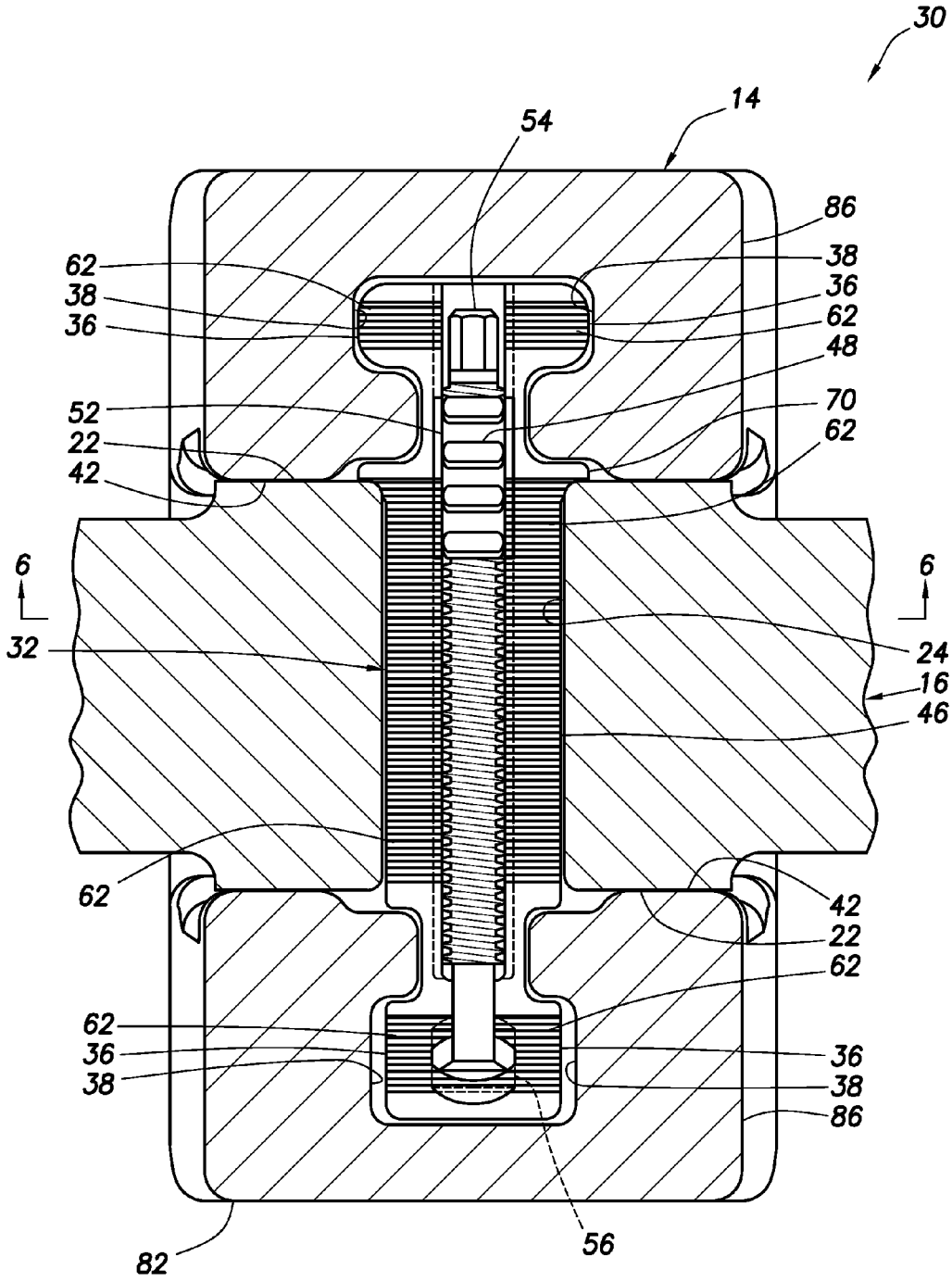
FIG. 5 is a cross-sectional view of the fastening system, taken along line 5-5 of FIG. 4.

Referring additionally now to FIG. 5, a cross-sectional view of the fastening system 30 is representatively illustrated, taken along line 5-5 of FIG. 4. The wedge 34 is not depicted in FIG. 5, so that an unobstructed view of the retainer 32 in the adapter 14 and lip 16 can be seen.

In this view, the manner in which the retainer 32 is received in the opening 24 of the lip 16, and in the recesses 38 of the adapter 14, can be more readily appreciated. Note that the retainer 32 can displace somewhat forward and rearward relative to the lip 16 but, even with the wedge 34 removed, the retainer is still captive within the adapter 14 and lip 16, as long as the adapter remains fully engaged on the lip.

This is a substantial benefit of the fastening system 30 because it prevents loss of the retainer 32 in operation, even if the wedge 34 should somehow become lost. It will be appreciated by those skilled in the art that loss of components such as the retainer 32 should be avoided, particularly in mining operations where the lost articles could damage other equipment used to process excavated material.

In practice, the retainer 32 is first installed in the opening 24 in the lip 16. A flange 70 on the retainer body 46 prevents the retainer 32 from falling through the opening 24.

The adapter 14 is then positioned on the lip 16 by sliding the adapter rearward onto the pads 20, 22. The projections 36 on the retainer 32 engage the recesses 38 in the adapter 14 as the adapter is slid rearward onto the lip 16.

At this point, the carrier 52 should be in its upper position as depicted in FIG. 4, with the carrier contacting the upper inclined surface 66 in the retainer body 46. The wedge 34 can then be installed, so that its rearward-facing side contacts the opening 60 in the adapter 14, and its forward-facing side contacts the retainer 32, with the serrations 62, 64 being engaged with each other.

Figure 6A:
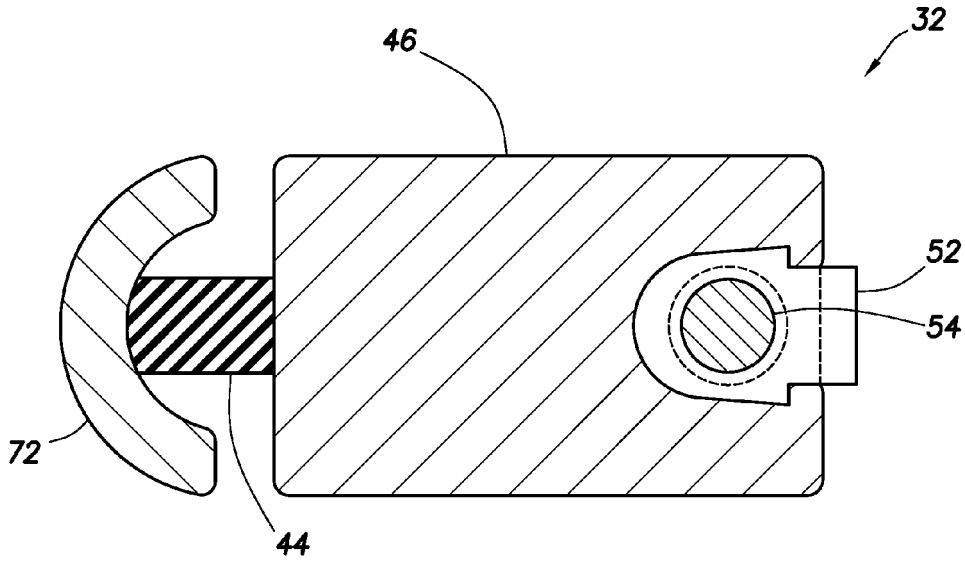
FIGS. 6A & B are cross-sectional views of a retainer 32 of the fastening system, taken along line 6-6 of FIG. 5.

Referring additionally now to FIGS. 6A & B, cross-sectional views of the retainer 32 are representatively illustrated apart from the remainder of the fastening system 30, with the views being taken along line 6-6 of FIG. 5. In FIG. 6A, the retainer 32 is depicted prior to the wedge 34 being installed, and in FIG. 6B, the retainer is depicted after the wedge has been fully installed.

Figure 6B:
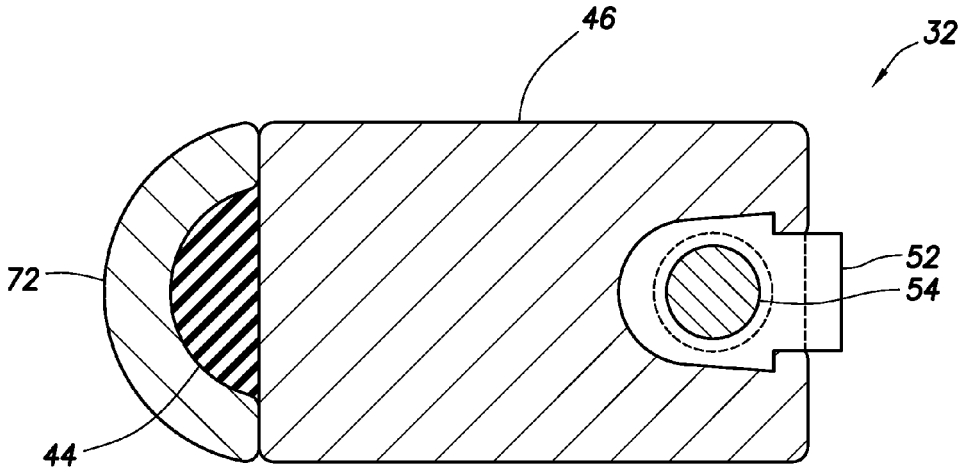

Note that, in FIG. 6A, the biasing device 44 is uncompressed, and a support 72 is spaced apart from the retainer body 46. However, when the biasing device 44 is fully compressed as a result of installing the wedge 34, the support 72 abuts the retainer body 46, as depicted in FIG. 6B.

Figure 7:
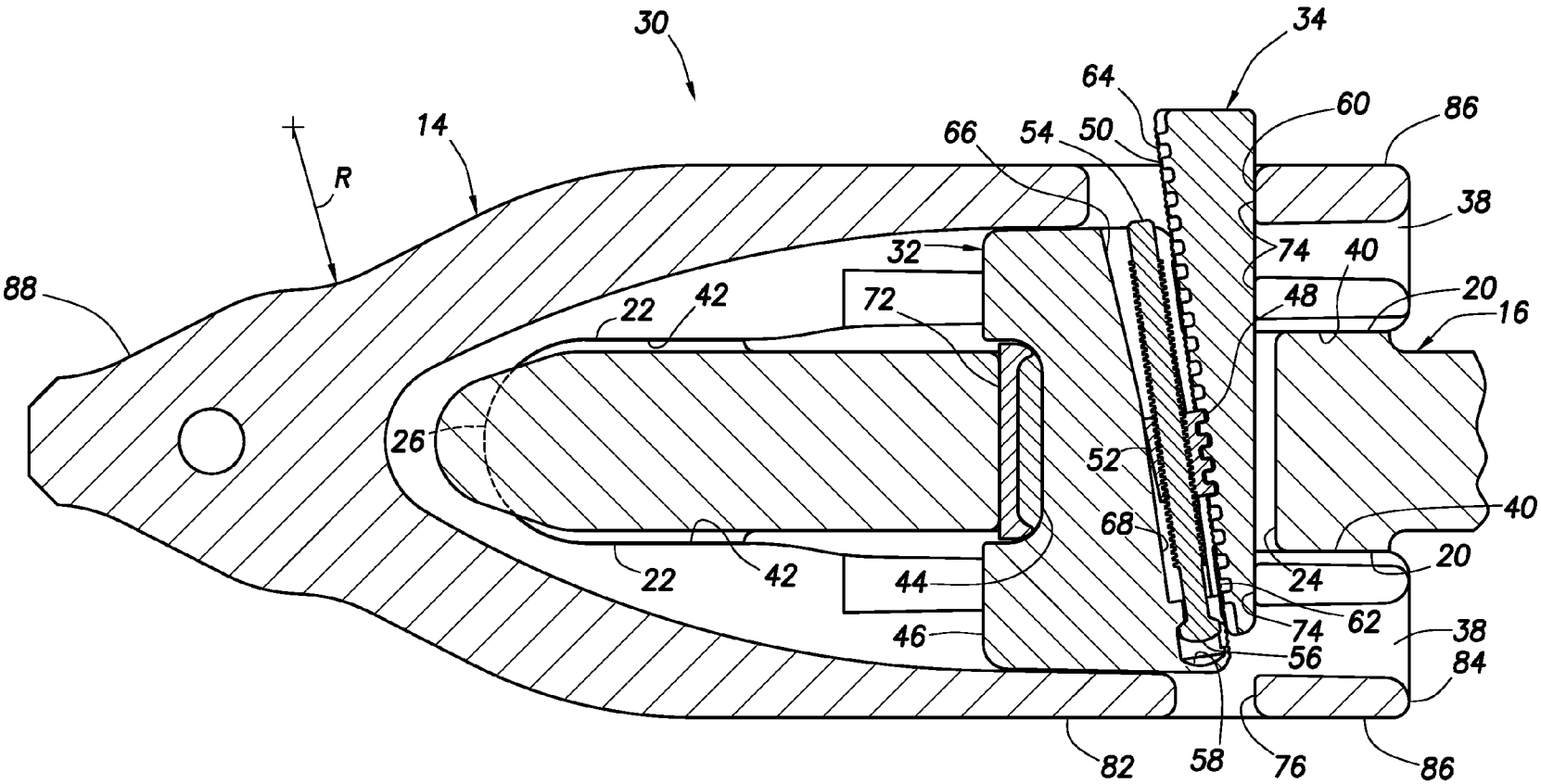
FIG. 7 is a cross-sectional view of the fastening system of FIG. 4, with a wedge fully installed therein.

The fully installed configuration of the fastening system 30 is representatively illustrated in FIG. 7. Note that the wedge 34 has been displaced downward relative to the adapter 14 and retainer 32, as a result of downward displacement of the carrier 52 and engagement of the teeth 48, 50 with each other.

The wedge 34 applies a rearwardly biasing force to each of surfaces 74 in the adapter 14. Note that the wedge 34 does not apply any biasing force directly to the opening 24 itself. This helps to prevent the wedge 34 from being dislodged due to the forces imparted to the adapter 14 in use.

The serrations 64 on the wedge 34 are engaged with the serrations 62 on the retainer 32, which engagement further prevents the wedge from being dislodged. Note that the resilience of the biasing device 44 enables the serrations 62, 64 to pass over one another as the carrier 52 is displaced downwardly, until the support 72 contacts the retainer body 46. Preferably, the teeth 48, 50 are more robust as compared to the serrations 62, 64, so that the teeth can still be used to displace the wedge 34 downwardly with the carrier 52, even though the serrations are engaged with each other.

As depicted in FIG. 7, the biasing device 44 is fully compressed, so that the support 72 contacts the retainer body 46. This provides a solid engagement between the retainer 32 and the opening 24 in the lip 16 as a result of fully installing the wedge 34. If, however, there should be wear of the mating surfaces of the adapter 14 and lip 16, or of any other components of the fastening system 30, the biasing device 44 can resiliently maintain engagement between the retainer 32 and the opening 24, engagement between the wedge 34 and the surfaces 74, and engagement between the retainer and the wedge.

The carrier 52 is in contact with the surface 68 on the retainer body 46. Thus, as the carrier 52 displaces upward or downward relative to the retainer body 46, the teeth 48 will remain engaged with the teeth 50, as long as the carrier remains in contact with the surface 68.

The head 56 of the threaded member 54 is fully upwardly displaced in the pocket 58 of the retainer body 46. The head 56 displaces upward somewhat in the pocket 58 as the carrier 52 is displaced downward from its position as depicted in FIG. 4 to its position as depicted in FIG. 7.

One benefit of the limited downward displacement of the head 56 permitted when the threaded member 54 is in the position depicted in FIG. 7 is that a downward force or impact applied to the wedge 34 can be absorbed by the components of the fastening system 30, without the teeth 48, 50 having to resist the full force or impact. Instead, the carrier 52 and threaded member 54 can displace downwardly somewhat with the wedge 34 relative to the retainer body 46 in response to the downward force or impact.

Note that the wedge 34 may in some circumstances (e.g., wear of the fastening system 30 components, wear of the opening 24, etc.) extend downwardly further than the position of the wedge as depicted in FIG. 7. In those circumstances, the wedge 34 could contact and apply a rearward biasing force to another forward-facing surface 76 formed on the adapter 14.

Figure 8:
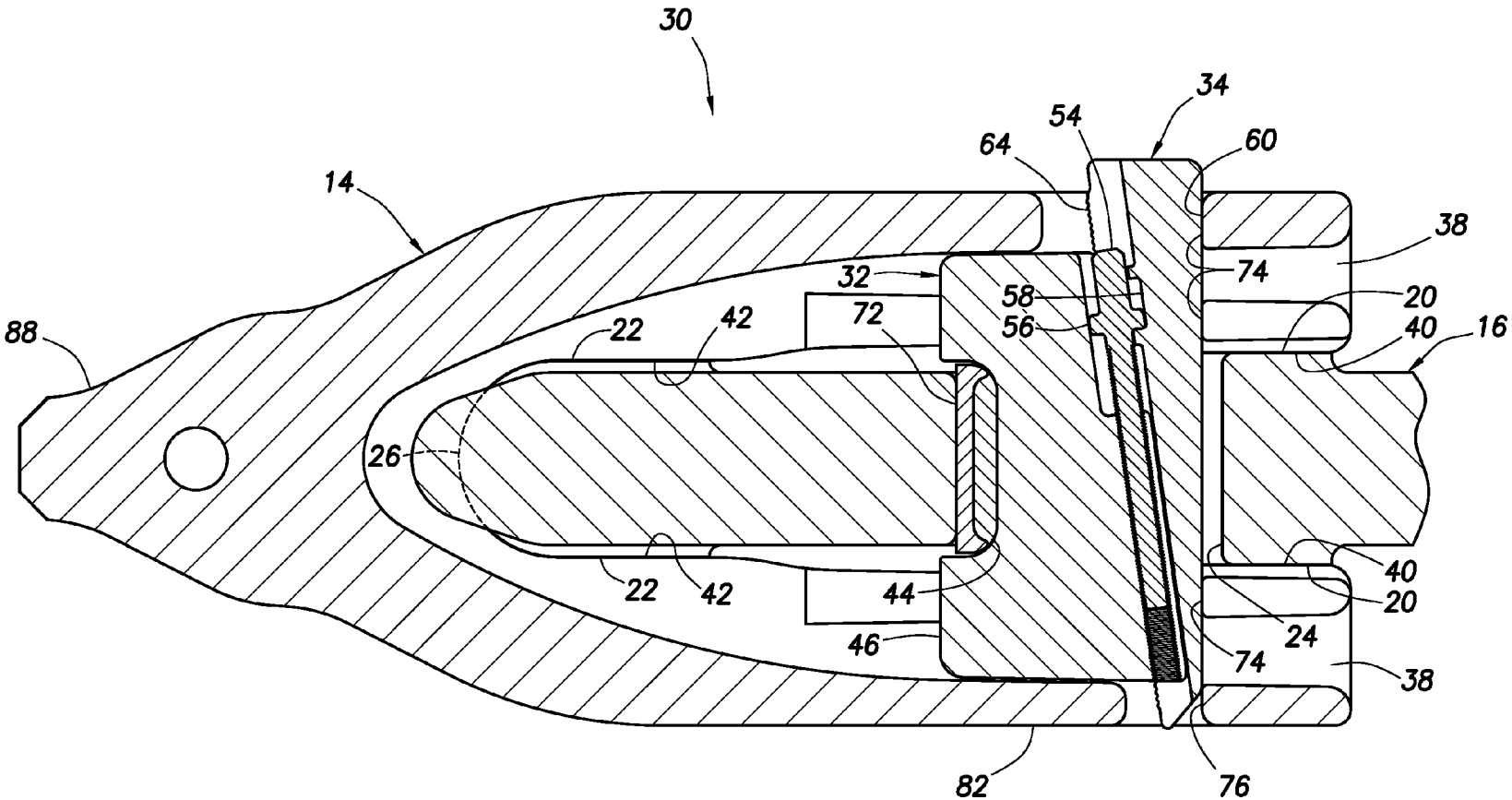
FIG. 8 is a cross-sectional view of another configuration of the fastening system.

Referring additionally now to FIG. 8, another configuration of the fastening system 30 is representatively illustrated. In this configuration, a carrier 52 is not displaced by rotating the threaded member 54.

Instead, the threaded member 54 has the radially enlarged head 56 which engages the pocket 58 formed in the wedge 34 (rather than in the retainer body 46, as in the configuration of FIGS. 4-7). Limited reciprocable displacement of the head 56 is permitted in the pocket 58.

The threaded member 54 is threadedly engaged with the retainer body 46. Rotation of the threaded member 54 in one direction will cause downward displacement of the threaded member relative to the retainer body 46, and rotation of the threaded member in an opposite direction will cause upward displacement of the threaded member relative to the retainer body.

Downward displacement of the threaded member 54 will draw the wedge 34 downwardly relative to the retainer 32, and thereby cause the wedge to apply a rearward biasing force to the surfaces 74, 76 as depicted in FIG. 8. This also biases the retainer 32 forward, and thereby compresses the biasing device 44 and applies a forward biasing force to the opening 24 in the lip 16.

The limited reciprocable displacement of the head 56 in the pocket 58 permits downward forces and impacts to be applied to the wedge 34 in operation, without those forces and impacts being transmitted directly to the threaded member 54. However, the wedge 34 can be conveniently removed from the adapter 14 by rotating the threaded member 54 so that it displaces upward and the head 56 contacts and applies an upward biasing force to the upper end of the pocket 58, thereby upwardly displacing the wedge.

Figure 9:
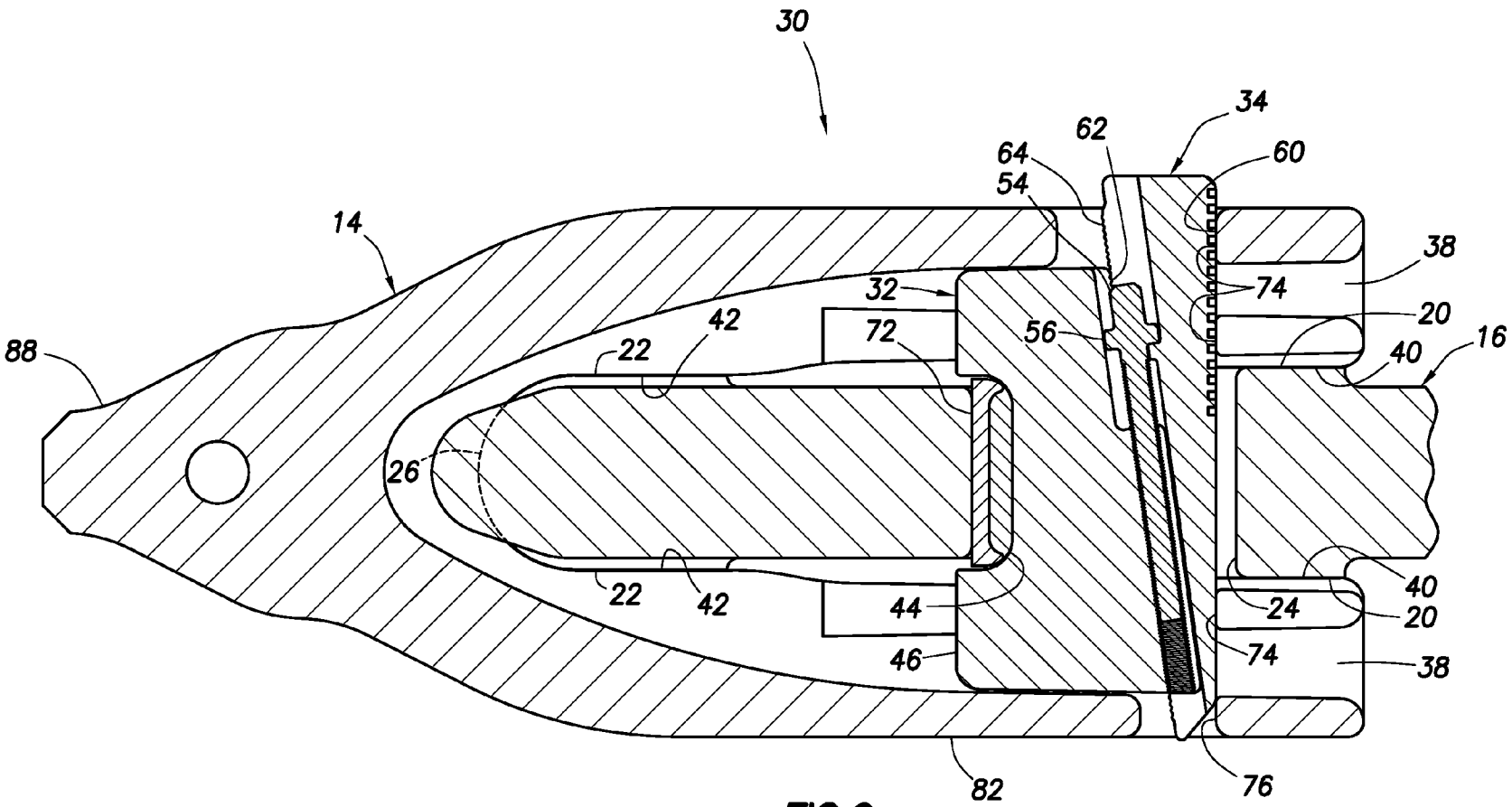
FIG. 9 is a cross-sectional view of yet another configuration of the fastening system.

Referring additionally now to FIG. 9, another configuration of the fastening system 30 is representatively illustrated. This configuration is similar in most respects to the configuration of FIG. 8.

However, one significant difference in the FIG. 9 configuration is that the head 56 of the threaded member 54 is not limited in its upward displacement relative to the wedge 34. Thus, the wedge 34 is not removed from the adapter 14 by upwardly displacing the threaded member 54 relative to the retainer body 46.

Figure 10:
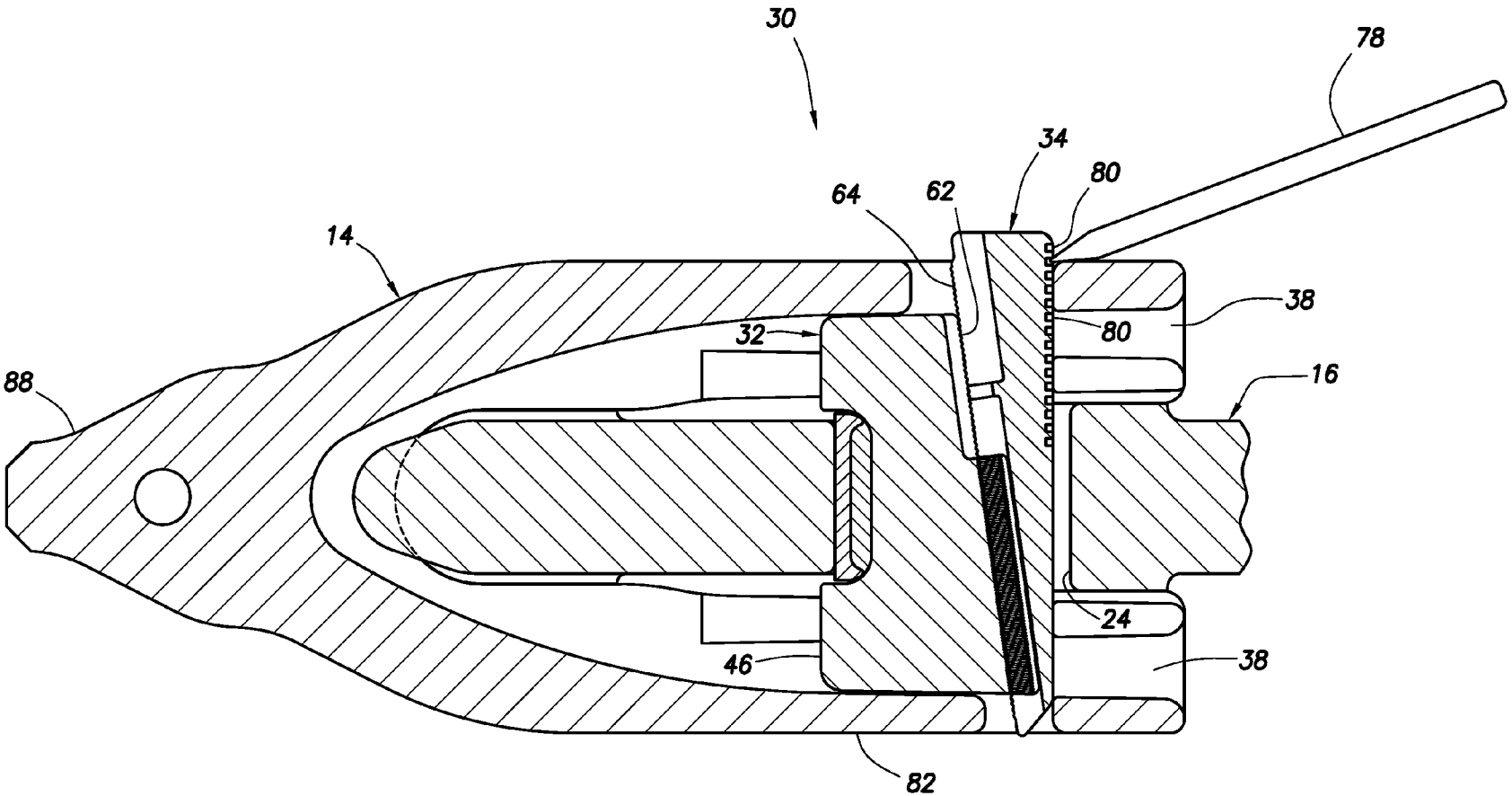
FIG. 10 is a cross-sectional view of the fastening system of FIG. 9, illustrating a wedge removal technique.

Instead, the wedge 34 can be removed from the adapter 14 by means of a lever 78, as representatively illustrated in FIG. 10. After unthreading the threaded member 54 from the retainer body 46, the lever 78 is engaged with one of multiple notches 80 formed on the wedge 34, and the lever is used to pry the wedge upward out of the adapter 14.

Note that the engagement between the serrations 62, 64 will resist upward displacement of the wedge 34, and so the notches 80 are preferably sufficiently robust to overcome the resistance supplied by the engagement between the serrations.

The adapter 14 as depicted in FIGS. 4, 5 and 7-10 includes a body 82 having a rear end 84 which is installed on the lip 16, with each of two legs 86 straddling the lip. A nose 88 for mounting a tooth 12 thereon is provided on a forward end of the adapter 14.

Preferably, a smooth transition is provided between the nose 88 and each of the legs 86, with there being an external radius of curvature R of no less than about 5 inches (~2 cm). This smooth transition contributes to the load carrying capacity and fatigue resistance of the adapter 14, particularly at the interface between the nose 88 and the adapter legs 86.

Figure 11:
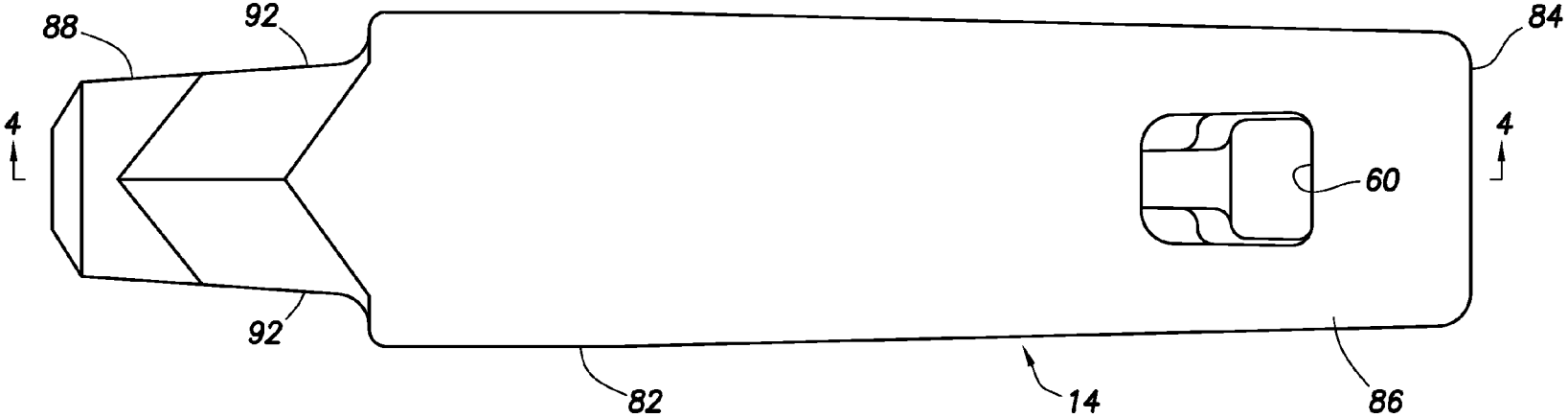
FIG. 11 is a top plan view of an adapter body.
Figure 12:
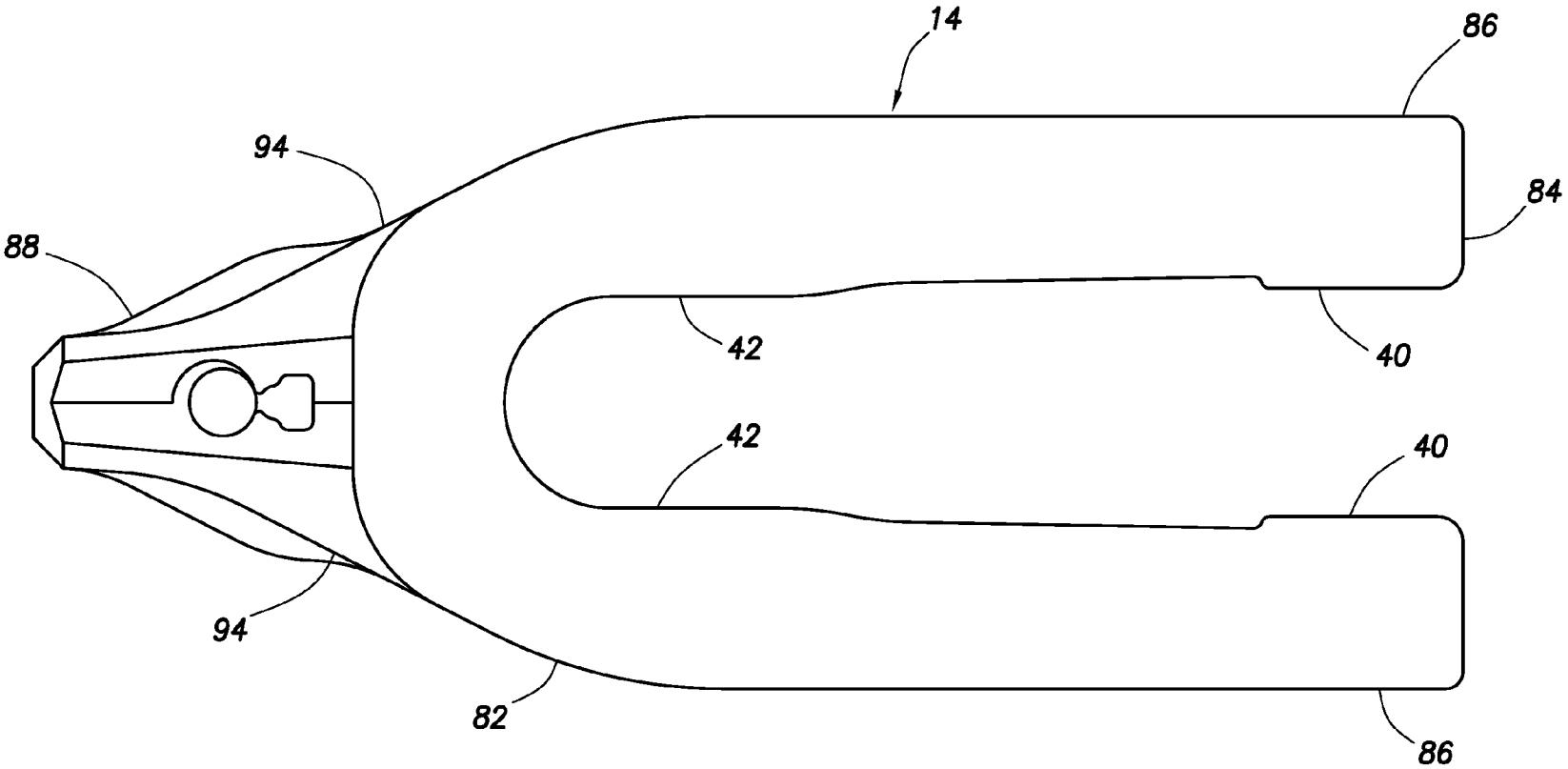
FIG. 12 is a side elevational view of the adapter body.

Representatively illustrated in FIGS. 11 & 12 are respective top and side views of the adapter 14. In these views it may be clearly seen that the transition between the nose 88 and the legs 86 of the adapter body 82 is very smooth.

Preferably, near opposite lateral sides 92 of the nose 88, the transition is a straight line 94 (i.e., an infinite radius), and in other examples the transition could even comprise a convex surface. Again, this smooth transition contributes to the load carrying capacity and fatigue resistance of the adapter 14.

It may now be fully appreciated that the above disclosure provides several improvements to the art of fastening an excavation tooth adapter to a lip of an excavation implement. In the fastening system 30 described above, the retainer 32 remains captive in the adapter 14, as long as the adapter remains fully engaged on the lip 16, even if the wedge 34 somehow becomes dislodged. In addition, the wedge 34 is prevented from dislodging by both movable teeth 48 and stationary serrations 62 on the retainer 32. Furthermore, the wedge 34 does not contact the lip opening 24, but instead applies a rearward biasing force directly to the adapter 14.

The above disclosure provides to the art a method of fastening an excavation tooth lip adapter 14 to a lip 16 of an excavation implement 10. The method can include installing a retainer 32 in an opening 24 formed through the lip 16, then engaging the adapter 14 with the retainer 32 and the lip 16, and then securing the adapter 14 to the lip 16 by biasing the retainer 32 forward relative to the lip.

Engaging the adapter 14 with the retainer 32 and the lip 16 may include preventing removal of the retainer from the opening 24.

Engaging the adapter 14 with the retainer 32 and the lip 16 may include engaging a projection 36 on the retainer with a longitudinally extending recess 38 formed in the adapter.

Securing the adapter 14 to the lip 16 may include installing a wedge 34 which biases the retainer 32 forward relative to the lip 16. The wedge 34 can bias the retainer 32 forward without contacting the opening 24.

Installing the wedge 34 can include engaging one or more teeth 50 of the wedge with one or more teeth 48 of the retainer 32. Installing the wedge 34 may also include displacing the wedge teeth 50 and the retainer teeth 48 relative to the adapter 32.

Installing the wedge 34 can include displacing one or more serrations 64 on the wedge relative to one or more serrations 62 on the retainer 32.

Displacing the wedge teeth 50 and the retainer teeth 48 may include rotating a threaded member 54 engaged with a carrier 52. Rotating the threaded member 54 may cause pivoting of the threaded member and carrier 52, thereby causing engagement between the wedge teeth 50 and the retainer teeth 48.

Also described above is a fastening system 30 for an excavation tooth lip adapter 14. The fastening system 30 can include a retainer 32 which is receivable in an opening 24 formed through a lip 16 of an excavation implement 10, with the retainer 32 including one or more movable teeth 48 and one or more stationary serrations 62. A wedge 34 biases the retainer 32 forward relative to the lip 16 when the retainer teeth 48 displace relative to the retainer serrations 62.

The wedge 34 preferably does not contact the opening 24 when the wedge biases the retainer 32 forward.

The wedge 34 may include one or more teeth 50 and one or more serrations 64, such that the wedge teeth 50 engage the retainer teeth 48, and the wedge serrations 64 engage the retainer serrations 62.

The retainer teeth 48 engagement with the wedge teeth 50, and the retainer serrations 62 engagement with the wedge serrations 64, may prevent removal of the wedge 34 from the adapter 14.

The retainer serrations 62 are preferably formed on a body 46 of the retainer 32. The retainer teeth 48 are preferably formed on a carrier 52 of the retainer 32, with the carrier being displaceable relative to the retainer body 46.

The carrier 52 may be displaceable by rotating a threaded member 54 relative to the carrier. The threaded member 54 can be reciprocably received in the retainer body 46. The carrier 52 and the threaded member 54 may pivot relative to the retainer body 46, so that the retainer teeth 48 engage one or more teeth 50 of the wedge 34.

The retainer 32 preferably remains captive in the adapter 14 upon removal of the wedge 34, and while the adapter remains on the lip 16. The retainer 32 may include a resilient biasing device 44 which biases the retainer rearward relative to the lip 16 when the wedge 34 biases the retainer forward.

The above disclosure also provides to the art a fastening system 30 which can include a retainer 32 which is receivable in an opening 24 formed through a lip 16 of an excavation implement 10, and in which the retainer 32 cannot be removed from the opening 24 while the adapter 14 remains fully engaged with the lip 16.

An adapter 14 which adapts an excavation tooth 12 to a lip 16 of an excavation implement 10 is also described above. The adapter 14 can include at least one generally longitudinally extending retainer 32 receiving recess 38 formed in a body 82 of the adapter.

A projection 36 formed on the retainer 32 is receivable in the recess 38 as the adapter 14 is installed on the lip 16.

An opening 60 may be formed through the adapter body 82. The retainer 32 preferably cannot be removed from the lip 16 through the opening 60. The opening 60 may include a forward-facing wedge 34 engaging surface 74.

The recess 38 may comprise a slot extending in a forward direction from a rear end 84 of the adapter 14.

Two retainer receiving recesses 38 may be formed in each of two legs 86 of the adapter body 82 which straddle the lip 16 upon installation on the lip.

A transition between a tooth 12 mounting nose 88 of the adapter body 82 and each of two legs 86 of the adapter body which straddle the lip 16 upon installation on the lip may have an external radius of curvature R of no less than about 2 cm. This provides a smooth transition between the nose 88 and the legs 86 of the adapter body 82.

The transition between the tooth mounting nose 88 of the adapter body 82 and each of the two legs of the adapter body 82 which straddle the lip 16 upon installation on the lip may comprise a straight line 94 near opposite lateral sides 92 of the nose88.

Also described above is an adapter 14 which adapts an excavation tooth 12 to a lip 16 of an excavation implement 10. The adapter 14 may include an opening 60 formed through a body 82 of the adapter, with the opening 60 including a forward-facing wedge 34 engaging surface 74.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below,"

"upper," "lower," "upward," "downward," etc., are used for convenience in referring to the accompanying drawings. These terms do not limit the principles of the disclosure.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A fastening system for an excavation tooth lip adapter, the fastening system comprising:

a retainer which is receivable in an opening formed through a lip of an excavation implement, the retainer including one or more movable teeth, one or more stationary serrations, and a resilient biasing device; and a wedge which biases the retainer forward relative to the lip when the retainer teeth displace relative to the retainer serrations, wherein the resilient biasing device is substantially compressed when the wedge biases the retainer forward.

2. The fastening system of claim 1, wherein the wedge does not contact the lip when the wedge biases the retainer forward.

3. The fastening system of claim 1, wherein the wedge includes one or more teeth and one or more serrations, wherein the wedge teeth engage the retainer teeth, and wherein the wedge serrations engage the retainer serrations.

4. The fastening system of claim 3, wherein the retainer teeth engagement with the wedge teeth, and the retainer serrations engagement with the wedge serrations, prevent removal of the wedge from the adapter.

5. The fastening system of claim 1, wherein the retainer serrations are formed on a body of the retainer, and wherein the retainer teeth are formed on a carrier of the retainer, the carrier being displaceable relative to the retainer body.

6. The fastening system of claim 5, wherein the carrier is displaceable by rotating a threaded member relative to the carrier.

7. The fastening system of claim 6, wherein the threaded member is reciprocably received in the retainer body.

8. The fastening system of claim 6, wherein the carrier and the threaded member pivot relative to the retainer body, whereby the retainer teeth engage one or more teeth of the wedge.

9. The fastening system of claim 1, wherein the retainer remains captive in the adapter upon removal of the wedge, while the adapter remains on the lip.

10. The fastening system of claim 1, wherein the resilient biasing device biases the retainer rearward relative to the lip when the wedge biases the retainer forward.

11. A fastening system for an excavation tooth lip adapter, the fastening system comprising:

a retainer which is receivable in an opening formed through a lip of an excavation implement, wherein the retainer includes one or more movable teeth and one or more stationary serrations, a recess in the adapter which receives a portion of the retainer, wherein the retainer cannot be removed from the opening while the portion of the retainer is engaged in the recess, and a wedge which biases the retainer forward relative to the lip when the retainer teeth displace relative to the retainer serrations, wherein the wedge does not contact the epees lip when the wedge biases the retainer forward.

12. A fastening system for an excavation tooth lip adapter, the fastening system comprising:

a retainer which is receivable in an opening formed through a lip of an excavation implement, wherein the retainer includes one or more movable teeth and one or more stationary serrations, a recess in the adapter which receives a portion of the retainer, wherein the retainer cannot be removed from the opening while the portion of the retainer is engaged in the recess, and a wedge which biases the retainer forward relative to the lip when the retainer teeth displace relative to the retainer serrations, wherein the wedge includes one or more teeth and one or more serrations, wherein the wedge teeth engage the retainer teeth, and wherein the wedge serrations engage the retainer serrations.

13. The fastening system of claim 12, wherein the retainer teeth engagement with the wedge teeth, and the retainer serrations engagement with the wedge serrations, prevent removal of the wedge from the adapter.

14. A fastening system for an excavation tooth lip adapter, the fastening system comprising:

a retainer which is receivable in an opening formed through a lip of an excavation implement, wherein the retainer includes one or more movable teeth and one or more stationary serrations, a recess in the adapter which receives a portion of the retainer, wherein the retainer cannot be removed from the opening while the portion of the retainer is engaged in the recess, and a wedge which biases the retainer forward relative to the lip when the retainer teeth displace relative to the retainer serrations, wherein the retainer serrations are formed on a body of the retainer, and wherein the retainer teeth are formed on a carrier of the retainer, the carrier being displaceable relative to the retainer body.

15. The fastening system of claim 14, wherein the carrier is displaceable by rotating a threaded member relative to the carrier.

16. The fastening system of claim 15, wherein the threaded member is reciprocably received in the retainer body.

17. The fastening system of claim 15, wherein the carrier and the threaded member pivot relative to the retainer body, whereby the retainer teeth engage one or more teeth of the wedge.

18. A fastening system for an excavation tooth lip adapter, the fastening system comprising:

a retainer which is receivable in an opening formed through a lip of an excavation implement, wherein the retainer includes one or more movable teeth and one or more stationary serrations, a recess in the adapter which receives a portion of the retainer, wherein the retainer cannot be removed from the opening while the portion of the retainer is engaged in the recess, and a wedge which biases the retainer forward relative to the lip when the retainer teeth displace relative to the retainer serrations, wherein the retainer remains captive in the adapter upon removal of the wedge, while the adapter remains on the lip.

19. A fastening system for an excavation tooth lip adapter, the fastening system comprising:

a retainer which is receivable in an opening formed through a lip of an excavation implement, wherein the retainer includes one or more movable teeth and one or more stationary serrations, a recess in the adapter which receives a portion of the retainer, wherein the retainer cannot be removed from the opening while the portion of the retainer is engaged in the recess, and a wedge which biases the retainer forward relative to the lip when the retainer teeth displace relative to the retainer serrations, wherein the retainer includes a resilient biasing device which biases the retainer rearward relative to the lip when the wedge biases the retainer forward.

20. A fastening system for an excavation tooth lip adapter, the fastening system comprising:

a retainer which is receivable in an opening formed through a lip of an excavation implement, the retainer including one or more movable teeth and one or more stationary serrations; and a wedge which is receivable in the opening, the wedge including one or more stationary teeth and one or more stationary serrations, wherein cooperative engagement between the retainer teeth and the wedge teeth secures the adapter onto the lip, and wherein engagement between the retainer serrations and the wedge serrations resists displacement of the wedge relative to the retainer during operation of the excavation implement.

21. The fastening system of claim 20, wherein the wedge biases the retainer forward relative to the lip during the cooperative engagement between the retainer teeth and the wedge teeth.

22. The fastening system of claim 21, wherein the wedge does not contact the lip when the wedge biases the retainer forward.

23. The fastening system of claim 21, wherein the retainer includes a resilient biasing device which biases the retainer rearward relative to the lip when the wedge biases the retainer forward.

24. The fastening system of claim 20, wherein the retainer teeth engagement with the wedge teeth, and the retainer serrations engagement with the wedge serrations, prevent removal of the wedge from the adapter.

25. The fastening system of claim 20, wherein the retainer serrations are formed on a body of the retainer, and wherein the retainer teeth are formed on a carrier of the retainer, the carrier being displaceable relative to the retainer body.

26. The fastening system of claim 25, wherein the carrier is displaceable by rotating a threaded member relative to the carrier.

27. The fastening system of claim 26, wherein the threaded member is reciprocably received in the retainer body.

28. The fastening system of claim 26, wherein the carrier and the threaded member pivot relative to the retainer body, whereby the retainer teeth engage one or more teeth of the wedge.

29. The fastening system of claim 20, wherein, upon removal of the wedge, the retainer is captive in the adapter while the adapter remains positioned on the lip.

* * * * *

UNITED STATES PATENT AND TRADEMARK OFFICE

CERTIFICATE OF CORRECTION

PATENT NO. : 8,302,333 B2
APPLICATION NO. : 12/768369
DATED : November 6, 2012
INVENTOR(S) : John A. Ruvang It is certified that error appears in the above-identified patent and that said Letters Patent is hereby corrected as shown below:

Claim 11, Column 10, line 3, cancel "epees".

Signed and Sealed this
Twenty-ninth Day of January, 2013

David J. Kappos

David J. Kappos
*Director of the United States Patent and Trademark Office*